US011654478B2

(12) United States Patent
Håkonsen et al.

(10) Patent No.: US 11,654,478 B2
(45) Date of Patent: May 23, 2023

(54) CASTING EQUIPMENT

(71) Applicant: NORSK HYDRO ASA, Oslo (NO)

(72) Inventors: Arild Håkonsen, Sunndalsøra (NO); Rune Ledal, Sunndalsøra (NO)

(73) Assignee: NORSK HYDRO ASA, Oslo (NO)

( * ) Notice: Subject to any disclaimer, the term of this patent is extended or adjusted under 35 U.S.C. 154(b) by 128 days.

(21) Appl. No.: 17/272,442

(22) PCT Filed: Aug. 19, 2019

(86) PCT No.: PCT/EP2019/072113

§ 371 (c)(1),
(2) Date: Mar. 1, 2021

(87) PCT Pub. No.: WO2020/052915

PCT Pub. Date: Mar. 19, 2020

(65) Prior Publication Data

US 2021/0323050 A1 Oct. 21, 2021

(30) Foreign Application Priority Data

Sep. 11, 2018 (NO) ..... 20181185

(51) Int. Cl.
*B22D 11/04* (2006.01)
*B22D 11/103* (2006.01)
(Continued)

(52) U.S. Cl.
CPC ..... *B22D 11/0401* (2013.01); *B22D 11/103* (2013.01); *B22D 11/181* (2013.01); *B22D 35/04* (2013.01); *B22D 37/00* (2013.01)

(58) Field of Classification Search
None
See application file for complete search history.

(56) References Cited

U.S. PATENT DOCUMENTS 2,742,492 A 4/1956 Harvey
3,552,478 A 1/1971 Lauener
(Continued)

FOREIGN PATENT DOCUMENTS

CN 103286286 9/2013
GB 1082413 9/1967
(Continued)

OTHER PUBLICATIONS

International Search Report and Written Opinion of the International Searching Authority dated Oct. 30, 2019, in International (PCT) Application No. PCT/EP2019/072113.

*Primary Examiner* — Scott R Kastler
(74) *Attorney, Agent, or Firm* — Wenderoth, Lind & Ponack, L.L.P.

(57) ABSTRACT

The invention provides a casting equipment (1) for casting melt (15) into a cast product (80) comprising a supply reservoir (10) for supplying the melt (15), a distribution reservoir (20), a casting apparatus (25) having a melt inlet connected to the distribution reservoir (20) for producing the cast product (80), a supply conduit (30) fluidly connecting the supply reservoir (10) and the distribution reservoir (20), an electromagnetic pump (35) provided on the supply conduit (30) and operable to generate a force in the melt (15) in the supply conduit (30), a level sensor (40) for measuring a level of the melt (15) in the distribution reservoir (20) and/or in the supply reservoir (10), a controller operably connected to the pump (35) and the level sensor (40), wherein the supply conduit (30) is sealed or sealable from a pressure of the atmosphere, wherein the controller is configured to control an operation of the pump (35) based on a level signal from the level sensor (40), and wherein, at least during a steady-state casting operation, the casting equipment is configured such that the supply conduit (30) defines a flow path that has a point that is higher than a surface of the melt
(Continued)

Figure 1:
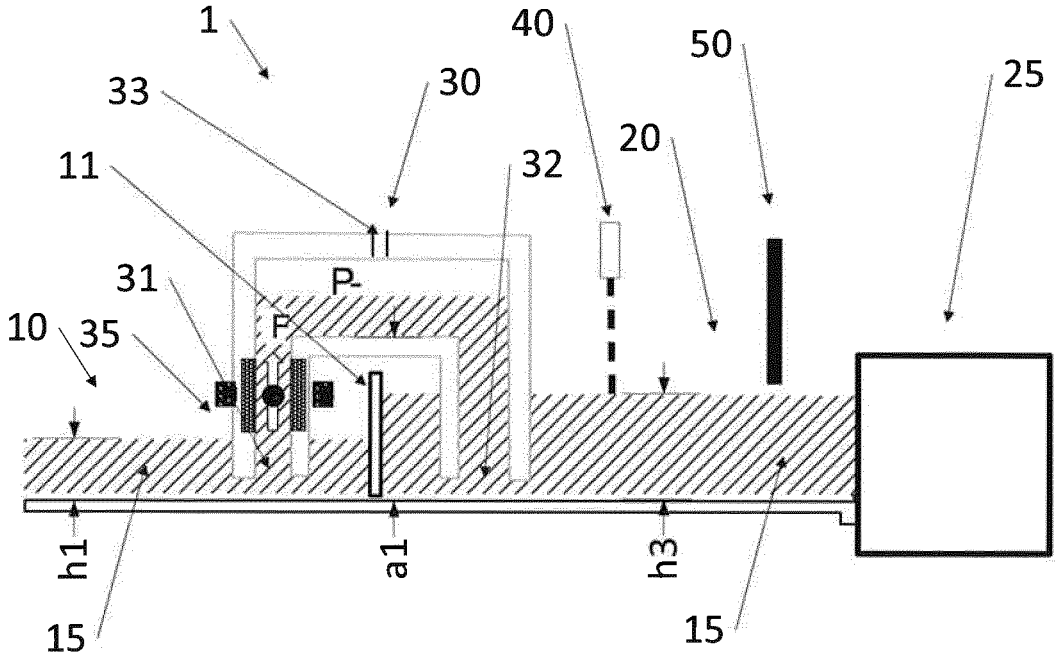

in the supply reservoir (10) and/or the distribution reservoir (20), and the pump (35) is operated such that the metal level in the distribution reservoir (20) is at a predefined level such as to control a pressure of the melt (15) in the melt inlet of the casting apparatus (25).

10 Claims, 2 Drawing Sheets

(51) Int. Cl.

| | |
|---|---|
| ***B22D 11/18*** | (2006.01) |
| ***B22D 35/04*** | (2006.01) |
| ***B22D 37/00*** | (2006.01) |

(56) References Cited

U.S. PATENT DOCUMENTS

| | | | | |
|---|---|---|---|---|
| 5,388,633 | A * | 2/1995 | Mercer, II | B22D 17/30 164/136 |
| 5,758,712 | A | 6/1998 | Pedersen | |
| 2010/0032455 | A1 | 2/2010 | Cooper et al. | |
| 2011/0048667 | A1 | 3/2011 | Vaagland et al. | |
| 2018/0185907 | A1 | 7/2018 | Røen et al. | |
| 2021/0323050 | A1* | 10/2021 | Håkonsen | B22D 11/103 |

FOREIGN PATENT DOCUMENTS

| | | |
|---|---|---|
| GB | 1 302 108 | 1/1973 |
| JP | 55-33825 | 3/1980 |
| JP | 07-1082 | 1/1995 |
| KR | 10-2011-0097678 | 8/2011 |
| WO | 2009/072893 | 6/2009 |

* cited by examiner

CASTING EQUIPMENT

TECHNICAL FIELD

The present invention relates to casting equipment allowing a precise control of a metal level in a distribution reservoir that is in fluid connection with a casting apparatus for producing a cast product to thereby enable casting cast products with high quality and high efficiency.

BACKGROUND

Casting equipment generally comprises a source for molten metal, e.g. a furnace, a casting apparatus for solidifying molten metal while giving it an intended shape, a conduit for transporting molten metal from the source to the casting apparatus and a flow control means to adjust, e.g. interrupt, a flow of liquid metal from the source to the casting apparatus to control the casting operation.

Patent application publication US20100032455A1 describes such a casting equipment having flow control means implemented by a valve having a moveable pin. US patent publication U.S. Pat. No. 2,742,492 describes an apparatus for controlling the flow of molten metal using an electro-magnetic field to control gravity-induced metal flow from a tundish into a casting mold.

WO 2009/072893 A1 discloses an arrangement related to equipment for continuous or semi-continuous casting of metal, in particular DC casting of aluminium. The apparatus comprises a supply channel and a distribution chamber for distributing the metal to the moulds. A metal lifting container is arranged in connection with the supply channels. Metal is sucked into the metal lifting container and lifted to a level that is higher than the level of the distribution chamber above the moulds. The metal lifting container is sealed from the surroundings and has a connection to a vacuum source.

U.S. Pat. No. 3,552,478 discloses a method for starting and maintaining the supply of metal to a downward operating continuous casting mould where molten metal is sucked through a suction pipe from a reservoir into a closed launder disposed above and connected to an air suction device.

GB 1,082,413 discloses an apparatus for vacuum degassing of molten metal, in particular steel. The apparatus further comprises an evacuation container into which leads a suction lift nozzle from a melt container and from which evacuation container leaves a discharge nozzle connected to a pouring jet degasifying chamber. For transportation of metal through the degassing apparatus, an electric pump can be provided.

However, a more efficient casting equipment allowing better control of a metal level is desirable.

SHORT DESCRIPTION OF THE INVENTION

The present invention provides a casting equipment for casting melt into a cast product comprising a supply reservoir for supplying the melt, a distribution reservoir, a casting apparatus having a melt inlet connected to the distribution reservoir for producing the cast product, a supply conduit fluidly connecting the supply reservoir and the distribution reservoir, an electromagnetic pump provided on the supply conduit and operable to generate a force in the melt in the supply conduit, a level sensor for measuring a level of the melt in the distribution reservoir and/or in the supply reservoir and for outputting a corresponding level signal, a controller operably connected to the pump and the level sensor, wherein the supply conduit is sealed or sealable from a pressure of the atmosphere, wherein the controller is configured to control an operation of the pump based on the level signal from the level sensor, and wherein, at least during a steady-state casting operation, the casting equipment is configured such that the supply conduit defines a flow path that has a point a1 that is higher than a surface of the melt in the supply reservoir and/or the distribution reservoir, and the pump is operated by the controller so that the metal level in the distribution reservoir is at an intended level such as to control a pressure of the melt in the melt inlet of the casting apparatus. In other words, the level is maintained in accordance with a level predefined for the actual casting operation. This may be static or may vary during the casting operation.

According to embodiments of the invention, the supply reservoir and the distribution reservoir are in direct fluid connection via a bypass valve that can be opened and closed, wherein the bypass valve is optionally implemented as a gate valve or dam.

According to embodiments of the invention, the supply reservoir, the supply conduit and the distribution reservoir form a supply siphon.

According to embodiments of the invention, the casting equipment may further comprise a shut-off valve that can be closed to interrupt a flow of the melt from the distribution reservoir to the casting apparatus, wherein the shut-off valve is optionally implemented as a gate valve or dam.

According to embodiments of the invention, the electromagnetic pump may be a direct current electromagnetic pump.

According to embodiments of the invention, at least during the steady-state casting operation, a level of the melt in the supply reservoir may be higher than the level of the melt in the distribution reservoir and the pump may be operated to generate a force that is at least partially countering a flow of melt from the supply reservoir to the distribution reservoir via the supply conduit in order to control a flow rate of melt from the supply reservoir to the distribution reservoir.

According to embodiments of the invention, at least during the steady-state casting operation, a level of the melt in the supply reservoir may be lower than the level of the melt in the distribution reservoir and the pump may be operated to generate a force that generates a flow of melt from the supply reservoir to the distribution reservoir via the supply conduit in order to control a flow rate of melt from the supply reservoir to the distribution reservoir.

According to embodiments of the invention, at least during the steady-state casting operation, the bypass valve may be closed and the shutoff valve may be open. According to embodiments of the invention, the melt may be molten aluminium or aluminum alloy.

According to embodiments of the invention, the casting apparatus may be a DC casting apparatus for continuously or semi-continuously casting, comprising at least one casting mold having an inlet for melt and an outlet for the at least partially solidified cast product, at least one starter block that is vertically moveable with respect to the at least one casting mold for supporting the cast product exiting the at least one casting mold, a distribution conduit that fluidly connects the distribution reservoir and the inlet of the at least one casting mold.

According to embodiments of the invention, at least during a steady-state casting operation, the casting equipment is configured such that the distribution conduit defines a flow path that has a point a2 that is higher than a surface of the melt in the casting mold and the surface of the melt in the distribution reservoir, wherein at least the distribution conduit is sealed or sealable from the pressure of the atmosphere, wherein the distribution reservoir, the distribution conduit and the at least one casting mold from a distribution siphon such that a metallostatic pressure of a surface of the melt in the distribution reservoir is equal to the metallostatic pressure of the surface of the melt in the mold.

According to embodiments of the invention, the supply conduit and/or the distribution conduit may be configured to be evacuated to generate an, with respect to the atmosphere surrounding the casting equipment, under pressure therein.

Pressures and heights and levels described herein are to be understood as relative pressures and heights and levels unless described to the contrary.

Other features, aspects, implementations, and advantages will become apparent from the description, the drawings, and other specifications of the invention.

SHORT DESCRIPTION OF THE FIGURES

Figure 2:
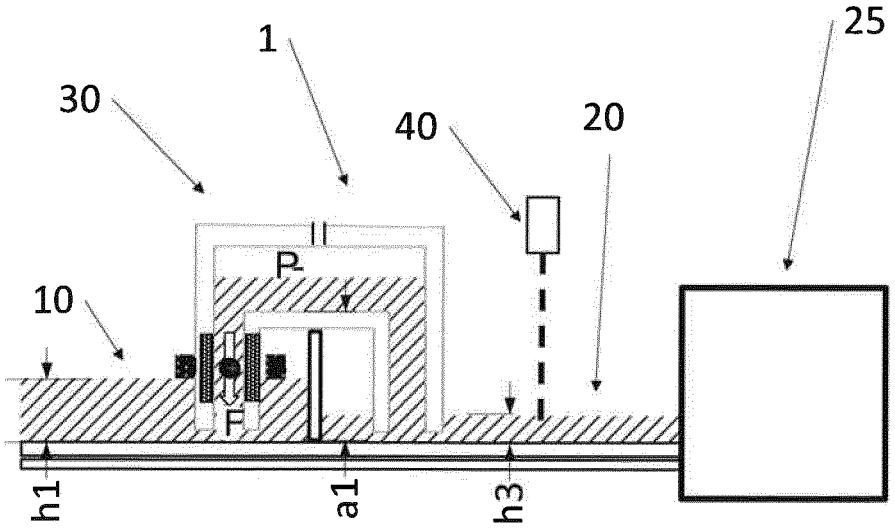
Figure 3:
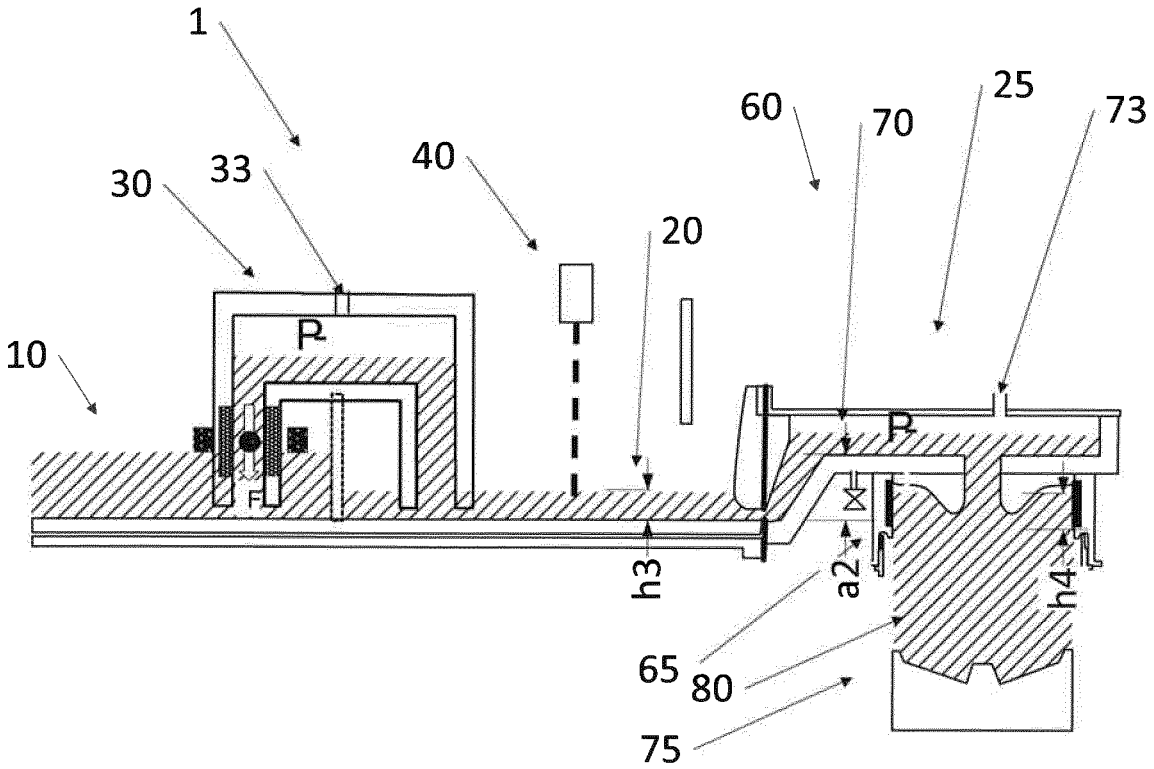

FIG. 1 shows a schematic view of a casting equipment according to embodiments of the invention, FIG. 2 shows a schematic view of a casting equipment according to embodiments of the invention, FIG. 3 shows a schematic view of a casting equipment according to embodiments of the invention, wherein the casting apparatus is implemented as a DC casting apparatus.

The figures are schematic and not necessarily to scale.

DETAILED DESCRIPTION

FIG. 1 shows a schematic view of a casting equipment 1 according to embodiments of the invention. The casting equipment 1 comprises a supply reservoir 10 for supplying melt (liquid metal) 15. The supply reservoir 10 may for example be implemented as a static, e.g. not tiltable and not moveable, melting furnace that can heat metal such that the metal melts. The supply reservoir 10 may also be implemented as a holding tank that is filled with liquid metal/melt 15 to temporarily store the liquid metal 15. The supply reservoir 10 may also be implemented as a holding furnace (i.e. a furnace that keeps the melt at an intended temperature but does not melt metal into melt) that stores the liquid metal 15.

Said holding furnace and holding tank may be static, e.g. not tiltable and not moveable. The supply reservoir 10 may also be implemented as a moveable container, such as a melting pot or crucible. In this case, the movable container is filled with melt 15 and is then moved to a location in proximity of an inlet 31 of a supply conduit 30 as described further below. In particular if the supply reservoir 10 is implemented in a static manner, e.g. as a melting furnace or holding tank, carrying out the casting process has been found to be much safer, as the casting equipment 1 according to the invention has a much-reduced potential for leakage of melt compared to using a moveable pin to control the metal level in a launder. Leakage of melt should be avoided, as this may result in melt spills on the floor of a cast house that may give rise to explosions.

The casting equipment 1 further comprises a distribution reservoir 20, also referred to as launder. The distribution reservoir 20 may temporarily hold melt 15 and supply it to a casting apparatus 25. An outlet of the distribution reservoir 20 may be fluidly connected to an inlet of the casting apparatus 25. The casting apparatus 25 may for example be a continuous casting apparatus, a semi-continuous casting apparatus as described below or any other casting apparatus that solidifies molten metal while giving it a predetermined shape. The distribution reservoir 20 may be fluidly connected to one or more casting apparatus 25 of the same or of different types.

During casting, melt 15 is supplied from the distribution reservoir 20 to the casting apparatus 25. However, in order to achieve good quality cast products, a metal level h3 in the distribution reservoir 20 must be precisely controlled, as the metal level h3 in the distribution reservoir 20 corresponds to an input pressure of melt entering the casting apparatus 25. This is because a level of the melt 15 in the distribution reservoir 20 corresponds to a metal input pressure of the casting apparatus 25 and the metal input pressure has been found to have an influence on the casting process and the obtained products.

Melt 15 may be supplied from the supply reservoir 10 to the distribution reservoir 20 via a supply conduit 30. During casting, the supply reservoir 10, the distribution reservoir 20 and the supply conduit 30 form a (supply) siphon. That is, during casting, an inlet 31 of the supply conduit 30 is submerged in melt 15 in the supply reservoir 10 and an outlet 32 of the supply conduit 30 is submerged in melt 15 in the distribution reservoir 20.

In other words, at least during a steady-state casting operation, the casting equipment 1 is configured such that the supply conduit 30 defines a flow path that has a point a1 that is higher than a surface of the melt in the supply reservoir 10 (c.f. metal level h1) and/or the distribution reservoir 20 (c.f. metal level h3), and a pump 35 is operated such that the metal level (h3) in the distribution reservoir 20 is at an intended level such as to control a metal input pressure of the casting apparatus 25.

The supply reservoir 10 and the distribution reservoir 20 may be separate reservoirs. A bypass valve, e.g. a dam valve, 11 may be provided to provide an optional direct fluid connection between the supply reservoir 10 and the distribution reservoir 20 that bypasses the supply conduit 30. However, the supply reservoir 10 and the distribution reservoir 20 may also be physically separate from each other and there may be no other fluid connection between them than the supply conduit 30.

An electromagnetic pump 35 is provided on the supply conduit 30 such as to generate a force/pressure in the melt 15 flowing through the supply conduit 30. In FIG. 1, the pressure/force generated by the pump 35 is indicated by the letter "F". The pump 35 may for example be provided on the supply conduit neighboring the inlet 31 or the outlet 32.

During casting, a flow of the melt 15 from the supply reservoir 10 to the distribution reservoir 20 via the supply conduit 30 may be controlled by the pump 35 such as to control the metal level h3 in the distribution reservoir 20.

The supply conduit 30 may optionally be configured to be evacuated to generate an, with respect to the atmosphere surrounding the casting equipment 1, under pressure therein. In FIG. 1, the under-pressure is indicated by the "P-" symbol. By controlling the underpressure in the supply conduit 30 and the electromagnetic pump 35 at the same time, the flow of melt 15 through the supply conduit 30 and consequently the melt level h3 in the distribution reservoir 20 may be controlled more precisely during a casting operation.

A vacuum port 33 may be provided on the supply conduit 30 to generate an underpressure with respect to the atmosphere in the supply conduit 30. A vacuum pump or other means for generating an under-pressure may be connected with the vacuum port 33 to lower a pressure in the supply conduit 30. For example, a vacuum pump based on the Venturi principle may be used to generate the under-pressure.

Priming the supply conduit 30, that is initially filling it with melt 15, may be achieved by the pump 35 if the pump is submerged in melt 15, e.g. when it is provided on side of the inlet 31 of the supply conduit 30. If the pump 35 is not submerged in melt 15, on a clean start of the casting equipment 1, the pump 35 may not be sufficient to prime the supply conduit 30, as it may not be able to efficiently generate a pressure in air. In this case, the supply conduit 30 can be primed by blocking the outlet 32 of the supply conduit 30, e.g. with a valve or a lid, and by applying an under-pressure on the vacuum port 33 so that melt 15 is transported from the supply reservoir 10 into the supply conduit 30. When the melt 15 reaches the pump 35, the pump 35 can be operated to transport the melt 15 into the distribution reservoir 20.

During casting, the pump 35 is operated to keep the metal level h3 in the distribution reservoir 20 at an intended level while melt 15 is consumed by the casting apparatus 25 to produce cast products. The casting equipment 1 may comprise one or more level sensors 40. A closed-loop control for the pump 35 may be implemented by providing a level sensor 40 to measure the level of melt 15. The level sensor 40 may be configured to measure a distance of the surface of the melt 15 from the sensor 40 e.g. by using a laser, RADAR radiation, acoustic waves, an inductive sensor or a capacitive sensor or the like, and to output a corresponding level signal. Via the distance, a level h1, h3 of the melt 15 can be calculated.

The level signal may be used to control the pump 35 such that the metal level remains at an intended value (SET VALUE), e.g. via a PID control algorithm or the like. The level sensor 40 may be provided such as to measure a melt level h1, h3 in the distribution reservoir 20 or in the supply reservoir 10. A more precise control can be achieved by providing at least two level sensors 40 to measure the melt levels in the distribution reservoir 20 and in the supply reservoir 10. While a control based on the metal level h3 in the distribution reservoir 20 has been described, due to the principle of conservation of mass and because the melt 15 does not undergo a significant change of specific volume in the casting equipment 1, the control of the metal level h3 may also be achieved by measuring a different metal level, e.g. a metal level h1 in the supply reservoir 10 or a metal level inside the casting apparatus 25 (not shown), and by controlling the pump 35 based on that measured metal level.

To control operation of the casting equipment 1, in particular operation of the electromagnetic pump 35, and, if provided in the embodiment, control of the pressure in the supply conduit 30 and/or the distribution conduit 70 (FIG. 3) as described further below, a controller, such as an electronic control unit (ECU), a computer or a distributed electronic control unit, may be operationally connected to the level sensor(s) 40, the electromagnetic pump 35 and/or the pressure sources connected with the vacuum ports 33 and/or 73 to control an operation of the casting equipment 1.

In embodiments of the invention that utilize an under-pressure in the supply conduit 30, a level sensor 40 may be provided to measure the level of melt 15 in the supply conduit 30 to enable a precise control of flow of melt 15. In addition or alternatively, in order to provide more precise control of the flow of melt 15, in embodiments of the invention that utilize an under-pressure in the supply conduit 30, a level sensor 40 may be provided on that side of the supply conduit 30 that is opposite to the side on which the pump 35 is provided. If for example the pump 35 is provided on a side of the inlet 31 of the supply conduit 30, a level sensor 40 may be provided to measure a level h3 of melt 15 in the distribution reservoir 20.

On the other hand, if for example the pump 35 is provided on a side of the outlet 32 of the supply conduit 30, a level sensor 40 may be provided to measure a level h1 of melt 15 in the supply reservoir 10.

According to the present invention and with reference to FIG. 2, the casting equipment 1 may be operated such that a metal level h1 in the supply reservoir 10 is higher than a metal level h3 in the distribution reservoir 20. In this case, due to the supply siphon arrangement formed by the supply conduit 30, the distribution reservoir 20 and the supply reservoir 10, the electromagnetic pump 35 is operated to counter the gravity-induced flow of the melt 15 from the supply reservoir 10 towards the distribution reservoir 20. That is, the pump 35 may be operated as a valve to control/counter/limit the gravity-induced flow of the melt from the supply reservoir 10 to the distribution reservoir 20. In FIG. 2, this is indicated by an arrow showing the operating direction of the pump 35.

According to the present invention and with reference to FIG. 1, the casting equipment 1 may also be operated such that a metal level h1 in the supply reservoir 10 is lower than a metal level h3 in the distribution reservoir 20. In this case, the electromagnetic pump 35 is operated to transport the melt 15 from the supply reservoir 10 towards the distribution reservoir 20 against the natural pressure gradient. In FIG. 1, this is schematically shown by the arrow indicating an operating direction of the pump 35.

The casting equipment 1 may optionally further comprise a shut-off valve 50. The shut-off valve 50 may be provided in the flow path between the distribution reservoir 30 and the casting apparatus 25. The shut-off valve 50 may for example be implemented as a dam or gate valve and may be used to interrupt the flow of melt 15 from the distribution reservoir 20 to the casting apparatus 25, for example during start-up of the casting equipment 1 to enable a controlled initial filling of the casting apparatus 25.

For example, the shut-off valve 50 may be closed until the metal level h3 in the distribution reservoir 20 has reached an intended level and may then be opened so that melt 15 can flow into the casting apparatus 25.

FIG. 3 shows a further embodiment of a casting equipment 1 according to the invention.

According to the embodiment shown in FIG. 3, the casting apparatus 25 is implemented as a DC ("direct chill) casting apparatus 60. The DC casting apparatus 60 comprises a casting mold 65, a distribution conduit 70 and a starter block 75. The distribution conduit 70 is fluidly connected with the distribution reservoir 30 and the casting mold 65 to transfer melt 15 from the distribution reservoir 20 into the casting mold 65 via an upper opening of the casting mold 65. Accordingly, in the embodiment shown in FIG. 3, the inlet of the casting apparatus 25 is connected to the distribution conduit 70. The melt 15 at least partially solidifies in the casting mold 65 (by heat transfer from the melt 15 to the casting mold 65 and/or the surroundings) and exits the casting mold 65 via a bottom opening as a cast product 80. The cast product 80 is supported by the starter block 75 that is vertically moveable with respect to the casting mold 65. Accordingly, a cast product 80 is produced while melt 15 is supplied into the casting mold 65 and the starter block 75 is continuously moved vertically downwards. During this operation, a quasi-stationary flow and pressure condition (steady-state casting) is reached. In this manner, a cast product 80, such as an extrusion ingot or a rolling slab or other longitudinal cast product, may be produced.

According to embodiments of the invention, the distribution conduit 70 and the casting mold 65 may optionally be sealed or sealable from the atmosphere. The distribution conduit 70 and the casting mold 65 may form a (distribution) siphon arrangement.

In other words, at least during a steady-state casting operation, the casting equipment 1 may be configured such that the distribution conduit 70 defines a flow path that has a point a2 that is higher than a surface of the melt (c.f. metal level h4) in the casting mold 65 and the surface of the melt 15 in the distribution reservoir 20, wherein at least the distribution conduit 70 is sealed or sealable from the pressure of the atmosphere, wherein the distribution reservoir 20, the distribution conduit 70 and the at least one casting mold (65) form a distribution siphon such that a metallostatic pressure of a surface of the melt 15 in the distribution reservoir 20 is equal to the metallostatic pressure of the surface of the melt 15 in the mold 65.

Accordingly, during casting, the level (or in other words the pressure) of the melt in the casting mold 65 may be adjusted by adjusting the level (or in other words the pressure) of the melt 15 in the distribution reservoir 20.

The distribution conduit 70 may optionally be configured to be evacuated to generate an, with respect to the atmosphere surrounding the casting equipment 1, under pressure therein. In FIG. 3, the under-pressure is indicated by the "P-" symbol. By controlling the under-pressure in the distribution conduit 70, the flow of melt 15 through the distribution conduit 70 and consequently the melt level in the casting mold 65 may be controlled more precisely during a casting operation, resulting in a higher quality of the cast product 80. The distribution conduit 70 may be provided with a vacuum port 73. Via the vacuum port 73, an under-pressure may be generated in the distribution conduit 70. A vacuum pump or other means for generating an under-pressure may be connected with the vacuum port 73 to lower a pressure in the distribution conduit 70. For example, a vacuum pump based on the Venturi principle may be used to generate the under-pressure.

Priming the distribution conduit 70, that is initially filling it with melt 15, by applying an under-pressure on the vacuum port 73 so that melt 15 is transported from the distribution reservoir 20 into the distribution conduit 70. Then, according to the siphon principle, melt 15 will automatically flow from the distribution reservoir 20 into the casting mold 65 via distribution conduit 70 when melt 15 is consumed by the casting process.

By this arrangement, a steady and precisely controllable flow of melt 15 from the supply reservoir 10 to the distribution reservoir 20 via the supply conduit 30 (supply siphon) and from the distribution reservoir 20 to the casting mold 65 via the distribution conduit 70 (distribution siphon) may be achieved.

The invention claimed is:

1. Casting equipment (1) for continuous or semi continuous casting melt (15) of molten aluminum or aluminum alloy into a cast product (80) comprising a supply reservoir (10) for supplying the melt (15), a distribution reservoir (20) for distributing melt to a casting apparatus (25), wherein the casting apparatus (25) has an inlet for the melt (15) from the distribution reservoir (20) for producing the cast product (80), a supply conduit (30) fluidly connecting the supply reservoir (10) and the distribution reservoir (20), an electromagnetic pump (35) provided on the supply conduit (30) and operable to generate a force/pressure in the melt (15) flowing through the supply conduit (30), a level sensor (40) for measuring a surface level (h3, h1) of the melt (15) in the distribution reservoir (20) and/or in the supply reservoir (10) and for outputting a corresponding level signal, a controller operably connected to the pump (35) and the level sensor (40), wherein the supply conduit (30) is sealed or sealable from a pressure of the atmosphere, wherein the controller is configured to control an operation of the pump (35) based on the level signal from the level sensor (40), and wherein, at least during a steady-state casting operation, the casting equipment (1) is configured such that the supply reservoir (10), the supply conduit (30) and the distribution reservoir (20) form a supply siphon, wherein the supply conduit (30) defines a flow path that is configured to have a point (a1) that is higher than a surface of the melt (15) in the supply reservoir (10) and/or the distribution reservoir (20), and the pump (35) is operated by the controller where the surface level (h3) of the melt (15) in the distribution reservoir (20) represents an input pressure of melt (15) entering the casting apparatus (25) to control the pressure of the melt (15) in the melt inlet of the casting apparatus (25), wherein the supply reservoir (10) and the distribution reservoir (20) are in direct fluid connection via a bypass valve (11) that can be opened and closed, and wherein the bypass valve (11) is a gate valve or dam.

2. The casting equipment (1) according to claim 1, further comprising a shut-off valve (50) that can be closed to interrupt a flow of the melt (15) from the distribution reservoir (20) to the casting apparatus (25), wherein the shut-off valve (50) is a gate valve or dam.

3. The casting equipment (1) according to claim 1, wherein the electromagnetic pump (35) is a direct current electromagnetic pump.

4. The casting equipment (1) according to claim 1, wherein the casting equipment (1) is configured to provide, at least during the steady-state casting operation, a level of the melt (15) in the supply reservoir (10) that is higher than the level of the melt (15) in the distribution reservoir (20) and the pump (35) that is operated to generate a force that is at least partially countering a flow of melt (15) from the supply reservoir (10) to the distribution reservoir (20) via the supply conduit (30) in order to control a flow rate of melt (15) from the supply reservoir (10) to the distribution reservoir (20).

5. The casting equipment (1) according to claim 1, wherein the casting equipment (1) is configured to provide, at least during the steady-state casting operation, a level of the melt (15) in the supply reservoir (10) that is lower than the level of the melt (15) in the distribution reservoir (20) and the pump (35) that is operated to generate a force that generates a flow of melt (15) from the supply reservoir (10) to the distribution reservoir (20) via the supply conduit (30) in order to control a flow rate of melt (15) form the supply reservoir (10) to the distribution reservoir (20).

6. The casting equipment (1) according to claim 1, wherein the casting equipment (1) is configured to provide, at least during the steady-state casting operation, the bypass valve (11) that is closed and the shut-off valve (50) that is open.

7. The casting equipment (1) according to claim 1, wherein the casting equipment (1) is effective to cast the melt (15) that is molten aluminium or aluminum alloy into a cast product (80).

8. The casting equipment (1) according to claim 1, wherein the casting apparatus (25) is a DC casting apparatus for continuously or semi-continuously casting comprising at least one casting mold (65) having an inlet for melt and an outlet for the at least partially solidified cast product (80), at least one starter block (75) that is vertically moveable with respect to the at least one casting mold (65) for supporting the cast product (80) exiting the at least one casting mold (65), a distribution conduit (70) that fluidly connects the distribution reservoir (20) and the inlet of the at least one casting mold (65) and forms the melt inlet.

9. The casting equipment (1) according to claim 8, wherein the casting equipment (1) is configured to provide, at least during a steady-state casting operation, the distribution conduit (70) that defines a flow path that has a point (a2) that is higher than a surface of the melt in the casting mold (65) and the surface of the melt (15) in the distribution reservoir (20), wherein at least the distribution conduit (70) is sealed or sealable from the pressure of the atmosphere, wherein the distribution reservoir (20), the distribution conduit (70) and the at least one casting mold (65) are configured to form a distribution siphon such that a metallostatic pressure of a surface of the melt (15) in the distribution reservoir (20) is equal to the metallostatic pressure of the surface of the melt (15) in the mold (65).

10. The casting equipment according to claim 1, wherein the supply conduit (30) and/or the distribution conduit (70) are configured to be evacuated such that the supply conduit (30) and/or the distribution conduit (70) have a pressure that is reduced with respect to the atmosphere surrounding the casting equipment (1).

* * * * *